US009104143B2

(12) United States Patent
Chun et al.

(10) Patent No.: US 9,104,143 B2
(45) Date of Patent: Aug. 11, 2015

(54) LIQUID ELECTROPHOTOGRAPHIC INKS

(71) Applicants: Doris Chun, Santa Clara, CA (US); Quang P Lam, Union City, CA (US); Hou T Ng, Campbell, CA (US)

(72) Inventors: Doris Chun, Santa Clara, CA (US); Quang P Lam, Union City, CA (US); Hou T Ng, Campbell, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/084,844

(22) Filed: Nov. 20, 2013

(65) Prior Publication Data

US 2014/0147783 A1 May 29, 2014

Related U.S. Application Data

(62) Division of application No. 13/455,747, filed on Apr. 25, 2012, now abandoned.

(51) Int. Cl.

| | |
|---|---|
| ***G03G 15/10*** | (2006.01) |
| ***G03G 13/10*** | (2006.01) |
| ***G03G 9/12*** | (2006.01) |
| ***G03G 9/125*** | (2006.01) |
| ***G03G 9/135*** | (2006.01) |

(52) U.S. Cl.

CPC ..... *G03G 13/10* (2013.01); *G03G 9/122* (2013.01); *G03G 9/125* (2013.01); *G03G 9/1355* (2013.01)

(58) Field of Classification Search

USPC ..... 430/112, 114, 116, 115, 117.1, 117.2, 430/118.2

See application file for complete search history.

(56) References Cited

U.S. PATENT DOCUMENTS

| | | | | |
|---|---|---|---|---|
| 5,744,269 | A * | 4/1998 | Bhattacharya et al. | 430/18 |
| 6,497,998 | B1 | 12/2002 | Dontula et al. | |
| 7,850,775 | B2 | 12/2010 | Hollman et al. | |
| 2010/0062360 | A1 * | 3/2010 | Victor | 430/111.41 |
| 2010/0095868 | A1 | 4/2010 | Kaupp et al. | |
| 2011/0118384 | A1 | 5/2011 | Bugnon et al. | |

FOREIGN PATENT DOCUMENTS

WO WO-2011136997 11/2011

OTHER PUBLICATIONS

Diamond, "The Handbook of Imaging Materials," Marcel Dekker, NY, NY, 1991. pp. 380-382.*

Eivazi, S., How to Get Changing Patterns on a Textile Surface by Using Pearl Luster and Color Travel Pigments, (Research Paper), Sep. 9, 2010.

Nadal, M. et al., Color Measurements for Pearlescent Coatings, (Web page), Feb. 10, 2003, pp. 38-42, vol. 29, No. 1. Online: http://www.mendeley.com/research/color-measurements-pearlescent-coatings/#page-1.

* cited by examiner

*Primary Examiner* — Peter Vajda

(74) *Attorney, Agent, or Firm* — HP Legal Department

(57) ABSTRACT

A liquid electrophotographic ink is disclosed. The liquid electrophotographic ink includes a carrier liquid, a polymer resin, and a pearlescent pigment particle.

19 Claims, No Drawings

LIQUID ELECTROPHOTOGRAPHIC INKS

CROSS-REFERENCE TO RELATED APPLICATION

The present application is a divisional application of Ser. No. 13/455,747, filed on Apr. 25, 2012, the contents of which are incorporated herein by reference.

BACKGROUND

The global print market is in the process of transforming from analog printing to digital printing. As compared to analog printing, digital printing may allow users to create high quality images with greater ability to customize individual prints. It may also allow users to create short runs of prints at a fraction of the cost of a similar run on a traditional analog press. Some known methods of digital printing include, but are not limited to, electrophotographic printing, full-color ink-jet printing, laser photo printing, and thermal transfer printing methods.

Electrophotographic printing techniques may involve the formation of a latent image on a photoconductor surface mounted on an imaging plate. In some examples, the photoconductor may first be sensitized to light, in one example through charging with a corona discharge, and then may be exposed to light projected through a positive film of the document to be reproduced. This may result in dissipation of the charge in the exposed areas and the formation of a latent image on the photoconductor. The latent image may subsequently be developed into a full image by the attraction of oppositely charged toner particles to the charge remaining on the unexposed areas. Next, the developed image may be transferred from the photoconductor to the blanket, which in one example is a fabric-reinforced sheet of rubber or polymer wrapped around a cylinder which may receive the toner from the photoconductor before it is transferred to the substrate. From the blanket, the image may be transferred to organic or inorganic substrates, such as paper, plastic or other suitable materials, by heat, pressure, a combination thereof, or any other suitable method, to produce the printed final image.

The latent image may be developed using either a dry toner (a colorant or pigment mixed with a powder carrier) or a liquid ink (a suspension of a colorant or pigment in a liquid carrier). In some examples, the quality of the final image may largely be related to the size of the colorant or pigment particles. Smaller particles may provide images with a higher resolution because the smaller particle size may allow for transfer of more particles in the same area and the delineation of finer details in the image.

DETAILED DESCRIPTION

Reference is now made in detail to specific examples of the ink including pearlescent pigment particles disclosed herein and specific examples of methods for creating the ink including pearlescent pigment particles. When applicable, alternative examples are also briefly described.

It is to be understood that other examples in which this disclosure may be practiced exist, and logical changes may be made without departing from the scope of the present disclosure. Therefore, the following detailed description is not to be taken in a limiting sense. Instead, the scope of the present disclosure is defined by the appended claims.

It is noted that, as used in this specification and the appended claims, the singular forms "a," "an," and "the" include plural referents unless the context clearly dictates otherwise.

As used herein, "electrophotographic printing" generally refers to the process that provides an image that is transferred from a photo imaging substrate either directly or indirectly via an intermediate transfer member. Additionally, "electrophotographic printers" generally refer to those printers capable of performing electrophotographic printing. "Liquid electrophotographic printing" or "LEP printing" is a specific type of electrophotographic printing in which a liquid ink or "LEP ink" is employed in the electrophotographic process rather than a powder toner.

As used herein, "carrier fluid," "carrier liquid", or "liquid vehicle" refers to the fluid in which the pigmented resin material of the present disclosure can be dispersed to form an ink dispersion. A carrier fluid can be formulated for electrophotographic printing such that the electrophotographic ink has a viscosity and conductivity for such printing, and may include one or more additives, including without limitation, surfactants, organic solvents, charge control agents, viscosity modifiers, stabilizing agents, and anti-kogation agents.

As used herein, a "print" or "printed media" is the combination of an organic or inorganic substrate and an ink or toner used to display a variety of forms or "images", including, but not limited to, text, graphics, characters, images, or photographs.

As used in this specification and the appended claims, "about" means a ±10% variance caused by, for example, variations in manufacturing processes.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "1 weight % (wt %) to 5 wt %" should be interpreted to include not only the explicitly recited values of 1 wt % to 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

As use of liquid electrophotographic ("LEP") printers increases, there is a growing need for LEP printers to be able to produce prints with the same types of special visual effects as analog presses. One such popular special visual effect is pearlescence. Images boasting a pearlescent effect may possess an iridescent luster resembling a pearl. This effect may be valued for the sheen and brilliance it imparts to the image which may help the image catch the attention of the viewer. In some examples, images including a pearlescent effect may be used in a number of applications including, but not limited to, advertising or the graphic arts. Images with a pearlescent effect may also be used in the security field, as the viewing angle-dependant optical effect of a pearlescent image may be difficult to reproduce via photograph, photocopy, or other duplication method. In some non-limiting examples, pearlescent images may be used as a security feature on documents, identity cards, or other sensitive items.

In the past, there have been two methods for obtaining prints with a pearlescent effect. The first method is to print commercially available ink on a pearlescent substrate, in one example, a substrate entirely covered with a pearlescent coating before printing. This method, however, may have several limitations. First, currently, only cellulose-based pearlescent substrates are commercially available. This limitation may prevent users from using this method in projects that call for the use of other substrates, such as metals or plastics. For example, a user would not be able to use this method to print on the flexible plastic substrates commonly used in packaging. Secondly, using a pearlescent substrate may also make it difficult to limit the pearlescent effect to a selected part of the image. For example, if a user wanted to use pearlescence in an image to simulate the metal body of a car, he or she may not be able to prevent the non-metallic wheels of the car from also appearing pearlescent. Third, pearlescent substrates may be very expensive.

The second method of obtaining prints with a pearlescent effect is through use of an ink including a pearlescent pigment, a pigment that when used in ink and printed on media creates a printed media with pearlescence. Although this method may allow for printing on a greater variety of substrates, including substrates that are not cellulose based, such inks are not currently commercially available.

A new LEP ink including pearlescent pigment particles capable of producing prints with a pearlescent effect on a variety of substrates is disclosed. Examples of the LEP ink disclosed herein include a carrier fluid, a polymer resin, and a pearlescent pigment particle. Additionally, in some examples and as further discussed below, the LEP ink disclosed herein may further include other additives. Finally, in some examples, the LEP ink disclosed herein may include colorant or pigment particles.

In one example, the carrier fluid acts as a dispersing medium for the other components in the LEP ink. In one example, non-polar carrier fluids may be used, wherein such non-polar carrier fluids may have one or more properties such as, but not limited to, low odor, lack of color, selective solvency, oxidation stability, low electrical conductivity, low skin irritation, low surface tension, desirable wetting, spreadability, low viscosity, narrow boiling point range, non-corrosive to metals, low freezing point, high electrical resistivity, high interfacial tension, low latent heat of vaporization, or low photochemical reactivity.

Specifically, examples of non-polar carrier liquids may include one or more substituted or unsubstituted hydrocarbons wherein the hydrocarbon may be linear, cyclic, or branched and may be substituted with any functional group. Some specific examples of such hydrocarbons may include, but are not limited to, dielectric liquids, non-oxidative water immiscible liquids, paraffins, isoparaffins, or oils.

In one example, the non-polar carrier liquid may include, but are not limited to, linear, branched, and cyclic alkanes having from about 6 to about 100 carbon atoms, inclusive; hydrocarbons having from 6 to 14 carbon atoms, inclusive; cycloalkanes having from 6 to 14 carbon atoms, inclusive (e.g., n-hexanes, heptanes, octane, dodecane, cyclohexane, etc.); t-butylbenzene; 2,2,4-trimethylpentane; isoparaffinic hydrocarbons; paraffinic hydrocarbons; aliphatic hydrocarbons; de-aromatized hydrocarbons; halogenated hyrdrocarbons; cyclic hydrocarbons; functionalized hydrocarbons; or combinations thereof. Specific examples of oil may include, but are not limited to, silicone oil, soy bean oil, vegetable oil, plant extracts, or combinations thereof. Specific examples of paraffins and isoparaffins include those in the ISOPAR® family (Exxon Mobil Corporation, Fairfax, Va., USA), including, but not limited to, ISOPAR® G, ISOPAR® H, ISOPAR® K, ISOPAR® L, or ISOPAR® M. In other examples, other hydrocarbons that may be used as the non-polar carrier liquid include those bearing the trade name SOLTROL® (available from Chevron Phillips Chemical Company, The Woodlands, Tex., USA) or SHELLSOL® (available from Shell Chemicals, Eschborn, Del., USA).

In one example, the hydrocarbon included in the non-polar carrier fluid may be substantially nonaqueous, i.e. containing less than 0.5 weight % (wt %) water. In another example, the hydrocarbon may be nonaqueous, i.e. containing no water.

In some examples, the polymer resin may be used in an LEP ink as a means for encapsulating the pigment during the production of the LEP ink. The polymer resin may also provide structural integrity for the ink film after printing, which may promote adhesion of the ink to the substrate and protect against rubbing or scratching. In some examples, the polymer resin may be a thermoplastic polymer. Examples of the polymer resin include, but are not limited to, ethylene acid copolymers; ethylene acrylic acid copolymers; methacrylic acid copolymers; ethylene vinyl acetate copolymers; copolymers of ethylene acid and alkyls, acrylic acid and alkyls, or methacrylic acid and alkyls (with carbon chain lengths between 1 and 20 carbons, inclusive); esters of methacrylic acid or acrylic acid; polyethylene; polystyrene; isotactic polypropylene(crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid where the alkyl is from 1 to about 20 carbon atoms, such as methyl methacrylate or ethylhexylacrylate); ethylene-acrylate terpolyrners; ethylene-acrylic esters; maleic anhydride (MAH) or glycidyl methacrylate (GMA) terpolyrners; low molecular weight ethylene-acrylic acid ionomers (i.e., those having a molecular weight less than 1000 amu); or combinations thereof. In one example, the polymer resin is selected from the NUCREL® or BYNEL® family of polymers (available from DuPont Company, Wilmington, Del., USA, e.g., NUCREL® 403, NUCREL® 407, NUCREL® 609HS, NUCREL® 908HS, NUCREL® 1202HC, NUCREL® 30707, NUCREL® 1214, NUCREL® 903, NUCREL® 3990, NUCREL® 910, NUCREL® 925, NUCREL® 609, NUCREL® 599, NUCREL® 960, NUCREL® RX 76, NUCREL® 2806, BYNEL® 2002, BYNEL® 2014, or BYNEL® 2020), the ACLYN® family of polymers (available from Honeywell International, Inc., Morristown, N.J., USA, e.g., ACLYN® 201, ACLYN® 246, ACLYN® 285, or ACLYN® 295), or the LOTADER® family of polymers (available from Arkema, Inc., King of Prussia, Pa., USA e.g., LOTADER® 2210, LOTADER® 3430, or LOTADER® 8200). In some instances, the polymer resin may have one or more functional groups such as carboxylic acid, ester, amide, amine, urea, anhydride, aromatic, or halogen based groups. Additionally, in some examples, any of the above listed polymer resins may be used alone or in combination with any of the above listed polymer resins.

The pearlescent pigment particles may be added to the LEP ink to allow images printed with the ink to have pearlescence or a pearl effect. Similar to the carrier fluid in the ink, different pearlescent pigment particles may have different characteristics, such as different sizes, dispersibility properties, hues, colors, or lightness. Additionally, different pigment particles may be further functionalized to contain different functional groups, which may further vary properties of the particle, including, but not limited to, hydrophilicity and hydrophobicity, acidity and basicity, or density of the particles.

In some examples, the pearlescent pigment particles may range in size from 10 nm to 100 μm or from 1 μm to 20 μm. In some examples, the ratio of resin to pearlescent pigment particle may be between 9:1 and 1:1 by weight.

In some examples, the pearlescent pigment particle may include any material that has pearlescent properties. Non-limiting examples of specific suitable pearlescent pigment particles may include aluminum flakes including a coating, aluminum particles including a coating, aluminum powder including a coating, mica, mica powder including a coating, mica particles including a coating, mica flakes including a coating, titanium, zinc oxide, titanium dioxide flakes, basic lead carbonate, or bismuth oxychloride. Suitable coatings in the above example include, but are not limited to, organic polymers such as acrylic polymer or co-polymer, methacrylic polymer or co-polymer, ethylene polymer or co-polymer, polyamide, polyacrylamide, polyester, polyurea, or polyurethane; inorganic polymers such as silicone-based polymers; or metal oxides such as silicon dioxide, titanium dioxide, iron oxide, or zinc oxide.

Finally, in some examples, the LEP ink may further include a pigment particle in order to create an ink that prints a color with a pearlescent effect. In one example, the pigment particle or colorant may be a colored pigment or colored polymeric particle in any possible color, such as RGB or CMYK, with a size ranging from 10 nm to 10 μm. In some examples, smaller particles, with a particle size from 1 to 10 nm, such as quantum dots, may be employed. In other examples, the particle size may range to a few micrometers. Additionally, organic or inorganic pigments may be used.

Organic and inorganic pigment particles may be selected from black pigment particles, yellow pigment particles, magenta pigment particles, red pigment particles, violet pigment particles, cyan pigment particles, blue pigment particles, green pigment particles, orange pigment particles, brown pigment particles or white pigment particles. In some instances, the organic or inorganic pigment particles may include spot-color pigment particles, which are formed from a combination of a predefined ratio of two or more primary color pigment particles.

A non-limiting example of a suitable inorganic black pigment includes carbon black. Examples of carbon black pigments include those manufactured by Mitsubishi Chemical Corporation, Japan (such as, e.g., carbon black No. 2300, No. 900, MCF88, No. 33, No. 40, No. 45, No. 52, MA7, MA8, MA100 or No. 0B); various carbon black pigments of the RAVEN® series manufactured by Columbian Chemicals Company, Marietta, Ga., (such as, e.g., RAVEN® 5750, RAVEN® 5250, RAVEN® 5000, RAVEN® 3500, RAVEN® 1255 or RAVEN® 700); various carbon black pigments of the REGAL® series, the MOGUL® series or the MONARCH® series manufactured by Cabot Corporation, Boston, Mass., (such as, e.g., REGAL® 400R, REGAL® 330R, REGAL® 660R, MOGUL® L, MONARCH® 700, MONARCH® 800, MONARCH® 880, MONARCH® 900, MONARCH ® 1000, MONARCH® 1100, MONARCH® 1300 or MONARCH® 1400); or various black pigments manufactured by Evonik Degussa Corporation, Parsippany, N.J., (such as, e.g., Color Black FW1, Color Black FW2, Color Black FW2V, Color Black FW18, Color Black FW200, Color Black S150, Color Black S160, Color Black S170, PRINTEX® 35, PRINTEX® U, PRINTEX® V, PRINTEX® 140U, Special Black 5, Special Black 6A or Special Black 4). A non-limiting example of an organic black pigment includes aniline black, such as C.I. Pigment Black 1.

Other examples of inorganic pigments include metal oxides and ceramics, such as the oxides of iron, zinc, cobalt, manganese or nickel. Non-limiting examples of suitable inorganic pigments include those from the Shepherd Color Company (Cincinnati, Ohio) such as Black 10C909A, Black 10P922, Black 1G, Black 20F944, Black 30C933, Black 30C940, Black 30C965, Black 376A, Black 40P925, Black 411A, Black 430, Black 444, Blue 10F545, Blue 10G511, Blue 10G551, Blue 10K525, Blue 10K579, Blue 211, Blue 212, Blue 214, Blue 30C527, Blue 30C588, Blue 30C591, Blue 385, Blue 40P585, Blue 424, Brown 10C873, Brown 10P835, Brown 10P850, Brown 10P857, Brown 157, Brown 20C819, Green 10K637, Green 187 B, Green 223, Green 260, Green 30C612, Green 30C654, Green 30C678, Green 40P601, Green 410, Orange 10P320, StarLight FL 37, StarLight FL105, StarLight FL500, Violet 11, Violet 11C, Violet 92, Yellow 10C112, Yellow 10C242, Yellow 10C272, Yellow 10P110, Yellow 10P225, Yellow 10P270, Yellow 196, Yellow 20P296, Yellow 30C119, Yellow 30C236, Yellow 40P140 or Yellow 40P280.

The following is a non-limiting list of organic pigments that may be used in accordance with the teachings herein. Non-limiting examples of suitable yellow pigments include C.I. Pigment Yellow 1, C.I. Pigment Yellow 2, C.I. Pigment Yellow 3, C.I. Pigment Yellow 4, C.I. Pigment Yellow 5, C.I. Pigment Yellow 6, C.I. Pigment Yellow 7, C.I. Pigment Yellow 10, C.I. Pigment Yellow 11, C.I. Pigment Yellow 12, C.I. Pigment Yellow 13, C.I. Pigment Yellow 14, C.I. Pigment Yellow 16, C.I. Pigment Yellow 17, C.I. Pigment Yellow 24, C.I. Pigment Yellow 34, C.I. Pigment Yellow 35, C.I. Pigment Yellow 37, C.I. Pigment Yellow 53, C.I. Pigment Yellow 55, C.I. Pigment Yellow 65, C.I. Pigment Yellow 73, C.I. Pigment Yellow 74, C.I. Pigment Yellow 75, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 99, C.I. Pigment Yellow 108, C.I. Pigment Yellow 109, C.I. Pigment Yellow 110, C.I. Pigment Yellow 113, C.I. Pigment Yellow 114, C.I. Pigment Yellow 117, C.I. Pigment Yellow 120, C.I. Pigment Yellow 124, C.I. Pigment Yellow 128, C.I. Pigment Yellow 129, C.I. Pigment Yellow 133, C.I. Pigment Yellow 138, C.I. Pigment Yellow 139, C.I. Pigment Yellow 147, C.I. Pigment Yellow 151, C.I. Pigment Yellow 153, C.I. Pigment Yellow 154, Pigment Yellow 155, C.I. Pigment Yellow 167, C.I. Pigment Yellow 172 or C.I. Pigment Yellow 180.

Non-limiting examples of suitable magenta or red or violet organic pigments include C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 40, C.I. Pigment Red 41, C.I. Pigment Red 42, C.I. Pigment Red 48(Ca), C.I. Pigment Red 48(Mn), C.I. Pigment Red 57(Ca), C.I. Pigment Red 57:1, C.I. Pigment Red 88, C.I. Pigment Red 112, C.I. Pigment Red 114, C.I. Pigment Red 122, C.I. Pigment Red 123, C.I. Pigment Red 144, C.I. Pigment Red 146, C.I. Pigment Red 149, C.I. Pigment Red 150, C.I. Pigment Red 166, C.I. Pigment Red 168, C.I. Pigment Red 170, C.I. Pigment Red 171, C.I. Pigment Red 175, C.I. Pigment Red 176, C.I. Pigment Red 177, C.I. Pigment Red 178, C.I. Pigment Red 179, C.I. Pigment Red 184, C.I. Pigment Red 185, C.I. Pigment Red 187, C.I. Pigment Red 202, C.I. Pigment Red 209, C.I. Pigment Red 219, C.I. Pigment Red 224, C.I. Pigment Red 245, C.I. Pigment Violet 19, C.I. Pigment Violet 23, C.I. Pigment Violet 32, C.I. Pigment Violet 33, C.I. Pigment Violet 36, C.I. Pigment Violet 38, C.I. Pigment Violet 43 or C.I. Pigment Violet 50.

Non-limiting examples of blue or cyan organic pigments include C.I. Pigment Blue 1, C.I. Pigment Blue 2, C.I. Pigment Blue 3, C.I. Pigment Blue 15, C.I. Pigment Blue 15:3, C.I. Pigment Blue 15:34, C.I. Pigment Blue 15:4, C.I. Pigment Blue 16, C.I. Pigment Blue 18, C.I. Pigment Blue 22, C.I. Pigment Blue 25, C.I. Pigment Blue 60, C.I. Pigment Blue 65, C.I. Pigment Blue 66, C.I. Vat Blue 4 or C.I. Vat Blue 60.

Non-limiting examples of green organic pigments include C.I. Pigment Green 1, C.I. Pigment Green2, C.I. Pigment Green 4, C.I. Pigment Green 7, C.I. Pigment Green 8, C.I. Pigment Green 10, C.I. Pigment Green 36 or C.I. Pigment Green 45.

Non-limiting examples of brown organic pigments include C.I. Pigment Brown 1, C.I. Pigment Brown 5, C.I. Pigment Brown 22, C.I. Pigment Brown 23, C.I. Pigment Brown 25, and C.I. Pigment Brown , C.I. Pigment Brown 41 or C.I. Pigment Brown 42.

Non-limiting examples of orange organic pigments include C.I. Pigment Orange 1, C.I. Pigment Orange 2, C.I. Pigment Orange 5, C.I. Pigment Orange 7, C.I. Pigment Orange 13, C.I. Pigment Orange 15, C.I. Pigment Orange 16, C.I. Pigment Orange 17, C.I. Pigment Orange 19, C.I. Pigment Orange 24, C.I. Pigment Orange 34, C.I. Pigment Orange 36, C.I. Pigment Orange 38, C.I. Pigment Orange 40, C.I. Pigment Orange 43 or C.I. Pigment Orange 66.

Additionally, in some examples, a LEP ink may further include a charge director. As used herein, the term "charge director" refers to a material that, when used, facilitates charging of the pearlescent pigment particles. In one example, the charge director may be basic and may react with the acid-modified pearlescent pigment particle to negatively charge the particle. In other words, the charging of the particle may be accomplished via an acid-base reaction (or interaction) between the charge director and the acid-modified particle surface. It is to be understood that the charge director may also be used in the LEP ink to prevent undesirable aggregation of the pearlescent pigment particles in the carrier fluid. In other examples, the charge director may be acidic and may react (or interact) with the base-modified colorant particle to positively charge the particle. Again, the charging of the pearlescent pigment particle may be accomplished via an acid-base reaction (or interaction) between the charge director and the base-modified particle surface.

The charge director may be selected from small molecules or polymers that are capable of forming reverse micelles in the non-polar carrier fluid. Such charge directors may be colorless and may tend to be dispersible or soluble in the carrier fluid. In a non-limiting example, the charge director may be selected from a neutral and non-dissociable monomer or polymer such as, e.g., a polyisobutylene succinimide amine, which has a molecular structure as follows:

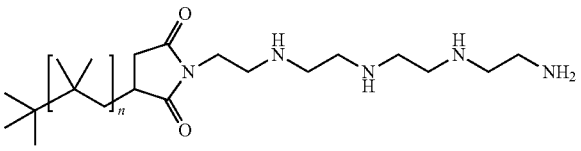

where "n" is an integer ranging from 15 to 100.

Another example of a charge director includes an ionizable molecule that is capable of disassociating to form charges. Non-limiting examples of such charge directors include sodium di-2-ethylhexylsulfosuccinate or dioctyl sulfosuccinate. The molecular structure of dioctyl sulfosuccinate is as follows:

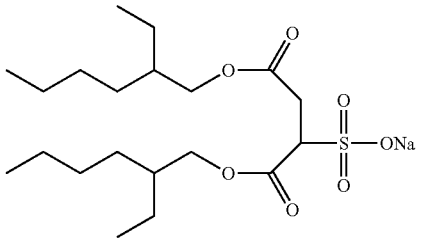

Yet another example of a charge director includes a zwitterion charge director such as, for example, lecithin. The molecular structure of lecithin is shown as follows:

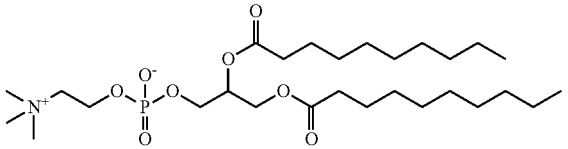

Finally, in some examples, the carrier fluid may further include other additives, such as charge control agents, dispersants, plasticizers, polymers, resins, rheology modifiers, salts, stabilizers, surfactants, UV curable materials, viscosity modifiers, surface-active agents, or combinations thereof. Such additives may serve to enhance print performance, improve the reliability of the printhead, improve the quality of images printed on media substrate or otherwise improve the quality of the ink or use of the ink. In some examples, such other additives may be between 0 wt % to 10 wt % of the ink.

In some examples, the concentration of pigment particles and other additives, such as dispersants, charge directors, or surfactants, in the LEP ink, may range from about 0.5 to 40 wt %. In one example, the concentration of the pearlescent pigment particles in the LEP ink may range from about 1 to 50 wt %. In such an example, the carrier fluid makes up the balance of the ink.

Turning now to systems that employ the LEP ink including pearlescent pigment particles disclosed herein, a liquid electrophotographic printing system may include a LEP printer and the LEP ink, as described herein, loaded therein.

In order to create a print demonstrating a pearlescent effect, in one example, the LEP ink including a pearlescent pigment particle as described herein is loaded into a LEP printer and printed onto a substrate. In one example, such a layer may be printed on a substrate already including one or more layers of pigmented or non-pigmented ink. In one example wherein one or more other layers of inks are present on the substrate, the one or more layers may be printed using an ink including a carrier fluid, a polymer resin, and a non-pearlescent colorant or pigment particle. In examples wherein the top printed layer includes ink including a pearlescent pigment particle as disclosed herein, the pearlescent effect may be visible in all areas of the substrate where the ink including a pearlescent pigment particle is printed. Because the pearlescent effect may be visible only in the areas of the substrate where the ink with the pearlescent pigment particle is printed, the user may be able to limit the pearlescent effect to selected areas of the print by not printing the ink with the pearlescent pigment particle in the areas the user wishes to be non-pearlescent.

In some examples, one or more additional layers of pigmented or non-pigmented ink may be printed on top of the pearlescent pigment layer. In some examples, subsequent pigmented print layers may obscure the pearlescent effect. In other examples, subsequent pigmented print layers may be used to limit the pearlescent effect to selected areas of the image.

Finally, in some examples, a transparent base layer of LEP ink including a carrier fluid and a polymer resin may be printed on the substrate before the pearlescent LEP ink layer. This transparent base layer may improve transfer of the pearlescent ink to the substrate by acting as an adhesion promoter, helping the pearlescent LEP ink layer stick to the substrate. In some examples, a transparent finishing layer of LEP ink including again only a carrier fluid and a polymer resin may be printed subsequent to the pearlescent LEP ink layer in order to improve the durability of the print. This finishing layer may improve the durability of the print by adding a layer of plastic coating on top of the print which may protect the print from damage.

The present methods, compositions, and systems describe an LEP ink that produces a resultant image with a pearlescent effect on a variety of substrates. The LEP ink compositions of the present disclosure may be suitable for use on many types of substrates, including but not limited to vinyl media, cellulose-based paper media, various cloth materials, polymeric materials (non-limitative examples of which include polyester white film or polyester transparent film), photopaper (non-limiting examples of which include polyethylene or polypropylene extruded on one or both sides of paper), metals, ceramics, glass, or mixtures or composites thereof.

EXAMPLE METHOD FOR MAKING A LEP INK INCLUDING PEARLESCENT PIGMENT PARTICLES

In one example, a carrier liquid and a polymer resin were first mixed together to form a resin mixture. Next, the resin mixture was heated until the resins melted and formed a homogenous clear viscous liquid. This liquid was allowed to cool until it formed a solid resin mixture. Once the liquid formed a solid, the solid resin mixture was broken up and pulverized into a fine powder and then mixed together with a powdered pearlescent pigment. Finally, the mixture of resin powder and pearlescent pigment powder was microfluidized and the resulting paste was collected for use in working dispersions of ink.

In other examples, any other suitable method may be utilized to make the LEP ink including pearlescent pigment particles as described herein. For example, while the present method steps are listed sequentially, it is understood that such steps are not necessarily performed in the recited order. For example, in one example, the step of mixing and the step of heating can be performed simultaneously. Additionally, in one aspect, the grinding step or the combining step can include adding a charge director or another additive.

What is claimed is:

1. A method of printing an image with a pearlescent effect on a substrate, including:

providing a base layer liquid electrophotographic ink, wherein the base layer liquid electrophotographic ink includes a base layer carrier liquid and a base layer polymer resin;

printing the base layer liquid electrophotographic ink onto an organic substrate or inorganic substrate;

providing a liquid electrophotographic ink, wherein the liquid electrophotographic ink includes a carrier liquid, a polymer resin, and a pearlescent pigment particle; and printing the liquid electrophotographic ink onto the organic substrate or inorganic substrate over the base layer.

2. The method of claim 1 wherein the carrier liquid is selected from the group consisting of substituted hydrocarbons and non-substituted hydrocarbons.

3. The method of claim 1 wherein the polymer resin is a thermoplastic polymer.

4. The method of claim 1 wherein the pearlescent pigment particle includes any material that has pearlescent properties.

5. The method of claim 1 wherein the pearlescent pigment particle includes a material selected from the group consisting of aluminum flakes, aluminum particles including a coating, aluminum powder including a coating, mica, mica powder including a coating, mica particles including a coating, mica flakes including a coating, titanium, zinc oxide, titanium dioxide flakes, basic lead carbonate, and bismuth oxychloride.

6. The method of claim 5 wherein the coating includes a material selected from the group consisting of organic polymers, inorganic polymers, and metal oxides.

7. The method of claim 1 wherein the liquid electrophotographic ink further includes an additive selected from the group consisting of charge control agents, charge directors, dispersants, pigment particles, plasticizers, polymers, resins, rheology modifiers, salts, stabilizers, surfactants, UV curable materials, viscosity modifiers, surface-active agents, and combinations thereof.

8. The method of claim 1 wherein the base layer carrier liquid is selected from the group consisting of substituted hydrocarbons and non-substituted hydrocarbons, and wherein the base layer polymer resin is a thermoplastic polymer.

9. The method of claim 1 wherein the base layer liquid electrophotographic ink further includes a base layer pigment particle, wherein the base layer pigment particle is selected from the group consisting of black pigment particles, yellow pigment particles, magenta pigment particles, red pigment particles, violet pigment particles, cyan pigment particles, blue pigment particles, green pigment particles, orange pigment particles, brown pigment particles, and white pigment particles.

10. The method of claim 1 further including:

providing an additional base layer liquid electrophotographic ink, wherein the additional base layer liquid electrophotographic ink includes an additional base layer carrier liquid, an additional base layer polymer resin, and an additional base layer pigment particle; and printing the additional base layer liquid electrophotographic ink onto the organic substrate or the inorganic substrate after printing the base layer liquid electrophotography ink onto the organic substrate or the inorganic substrate.

11. The method of claim 10 wherein the additional base layer carrier liquid is selected from the group consisting of substituted hydrocarbons and non-substituted hydrocarbons, and wherein the additional base layer polymer resin is a thermoplastic polymer.

12. The method of claim 10 wherein the additional base layer pigment particle is selected from the group consisting of black pigment particles, yellow pigment particles, magenta pigment particles, red pigment particles, violet pigment particles, cyan pigment particles, blue pigment particles, green pigment particles, orange pigment particles, brown pigment particles, and white pigment particles.

13. The method of claim 1, including:

providing a finishing layer liquid electrophotographic ink, wherein the finishing layer liquid electrophotographic ink includes a finishing layer carrier liquid and a finishing layer polymer resin; and printing the finishing layer liquid electrophotographic ink onto the organic substrate or the inorganic substrate after printing the liquid electrophotography ink onto the organic substrate or the inorganic substrate.

14. The method of claim 13 wherein the finishing layer carrier liquid is selected from the group consisting of substituted hydrocarbons and non-substituted hydrocarbons, and wherein the finishing layer polymer resin is a thermoplastic polymer.

15. The method of claim 13 wherein the finishing layer liquid electrophotographic ink further includes a finishing layer pigment particle.

16. The method of claim 15 wherein the finishing layer pigment particle is selected from the group consisting of black pigment particles, yellow pigment particles, magenta pigment particles, red pigment particles, violet pigment particles, cyan pigment particles, blue pigment particles, green pigment particles, orange pigment particles, brown pigment particles, and white pigment particles.

17. The method of claim 13 further including:

providing an additional finishing layer liquid electrophoto graphic ink, wherein the additional finishing layer liquid electrophoto graphic ink includes an additional finishing layer carrier liquid, an additional finishing layer polymer resin, and an additional finishing layer pigment particle; and printing the additional finishing layer liquid electrophotographic ink onto the organic substrate or the inorganic substrate before printing the finishing layer liquid electrophotography ink onto the organic substrate or the inorganic substrate.

18. The method of claim 17 wherein the additional finishing layer carrier liquid is selected from the group consisting of substituted hydrocarbons and non-substituted hydrocarbons, and wherein the additional finishing layer polymer resin is a thermoplastic polymer.

19. The method of claim 17 wherein the additional finishing layer pigment particle is selected from the group consisting of black pigment particles, yellow pigment particles, magenta pigment particles, red pigment particles, violet pigment particles, cyan pigment particles, blue pigment particles, green pigment particles, orange pigment particles, brown pigment particles, and white pigment particles.

* * * * *

UNITED STATES PATENT AND TRADEMARK OFFICE

CERTIFICATE OF CORRECTION

PATENT NO. : 9,104,143 B2
APPLICATION NO. : 14/084844
DATED : August 11, 2015
INVENTOR(S) : Doris Chun et al.

It is certified that error appears in the above-identified patent and that said Letters Patent is hereby corrected as shown below:

Claims

In column 12, lines 2-3, in Claim 17, delete "electrophoto graphic" and insert -- electrophotographic --, therefor.

In column 12, line 4, in Claim 17, delete "electrophoto graphic" and insert -- electrophotographic --, therefor.

Signed and Sealed this
Fifth Day of April, 2016

Michelle K. Lee

Michelle K. Lee
*Director of the United States Patent and Trademark Office*